United States Patent [19]

Thibaut

[11] Patent Number: 4,551,902

[45] Date of Patent: Nov. 12, 1985

[54] DEVICE FOR MOUNTING AND REMOVAL OF POLISHING WHEELS IN MACHINES FOR POLISHING STONES OR LIKE MATERIALS

[75] Inventor: Bernard Thibaut, Vire, France

[73] Assignee: Thibaut S.A., Vire, France

[21] Appl. No.: 647,696

[22] Filed: Sep. 5, 1984

[30] Foreign Application Priority Data

| | | | |
|---|---|---|---|
| Sep. 6, 1983 | [FR] | France | 83 14183 |
| Jun. 19, 1984 | [FR] | France | 84 09547 |
| Aug. 17, 1984 | [EP] | European Pat. Off. | 84401684.0 |

[51] Int. Cl.[4] ..... B24D 7/16; B23Q 3/157; B24B 45/00

[52] U.S. Cl. ..... 29/568; 51/168; 83/666

[58] Field of Search ..... 51/168, 166 R, 166 TS, 51/166 MH; 408/239 A; 279/1 Q, 23; 29/568, 26 A, 426.7; 83/666, 698, 169

[56] References Cited

U.S. PATENT DOCUMENTS 3,898,010 8/1975 Jungbluth et al. ..... 29/426.6

FOREIGN PATENT DOCUMENTS

| | | | |
|---|---|---|---|
| 0060638 | 9/1982 | European Pat. Off. | 29/26 A |
| 2844088 | 5/1980 | Fed. Rep. of Germany | 29/26 A |
| 2357333 | 3/1978 | France | 51/168 |
| 2484889 | 12/1981 | France . | |

*Primary Examiner*—Roscoe V. Parker
*Attorney, Agent, or Firm*—Young & Thompson

[57] ABSTRACT

The device for mounting and removal of polishing wheels comprises a cup-shaped support of partially elastic material and fitted on the mounting face of a polishing wheel. A receiving plate is forcibly engaged within the support by elastic deformation of the cup and rigidly fixed to the end of a driving shaft. A duct formed in the bottom wall of the cup serves to discharge air at the time of assembly or to blow-in compressed air between the cup and the receiving plate for subsequent uncoupling of these two components and removal of the corresponding polishing wheel.

13 Claims, 9 Drawing Figures

DEVICE FOR MOUNTING AND REMOVAL OF POLISHING WHEELS IN MACHINES FOR POLISHING STONES OR LIKE MATERIALS

BACKGROUND OF THE INVENTION

1. Field of the Invention

This invention relates to a device for facilitating mounting and removal of polishing wheels in machines for polishing stones or like materials.

2. Description of the Prior Art

As a general rule, machines of this type comprise one or a number of carriages each equipped with a polishing head which comprises a number of polishing wheels. These wheels are removably mounted on the different rotary shafts of the polishing head. To this end, each polishingwheel is usually fixed by bonding to a support in the form of a disk or plate which is in turn fixed by screwing on one of the rotary shafts of a polishing head.

As the work proceeds, it is necessary to replace the polishing wheels by other wheels which have a different grain size (grit). Thus provision has to be made for five wheel changes as well as replacement of polishing wheels which have become dulled during a work cycle. However, screwing and unscrewing of wheel-holding plates involve a number of tedious manual operations which entail the need to withdraw the machine from service over considerable periods of time.

For the reason just mentioned, different wheelmounting systems have recently been proposed for the purpose of reducing the length of time required for carrying out these manual wheel-changing operations.

Thus French Pat. No. FR-A 2,357,333 describes a wheel-holding device comprising series of jaws pivotally mounted on a support fixed on the rotary shaft of a polishing head and adapted to clamp the upper end of a polishing wheel. These jaws are accordingly controlled by a ring attached by screwing to their support and capable of clamping these latter against the upper end of a wheel. Means are also provided for causing resilient opening of the pivotal jaws when the clamping ring is moved to the released position.

French Pat. No. FR-A 2,484,889 describes a device of rather similar type. This device comprises a series of resilient claws for gripping the upper end of a wheel or more precisely the frusto-conical collar of a wheel-holding plate which is separately mounted on a wheel of this type. These claws are carried by a support fixed on the rotary shaft of a polishing head and normally tend to withdraw outwards to the open position. However, the clamping action of said claws can be produced by means of a movable operating member in the form of a ring which is subjected to the action of a thrust spring.

In both instances, however, the systems just mentioned still require a certain number of manual operations for mounting and removing polishing wheels one after the other, which always takes a considerable length of time. Thus in the case of the system described in French Pat. No. FR-A 2,484,889, removal of a wheel calls for the use of a special tool in the form of a tong unit for moving the clamping ring away from the claws in order to permit resilient withdrawal of these latter for the purpose of releasing the corresponding wheel.

Furthermore, the basic design concept of these clamping systems does not permit any possibility of automation of operations which involve mounting and removal of wheels with respect to a polishing head.

SUMMARY OF THE INVENTION

For this reason, the aim of the present invention is to provide a device of very simple constructional design in order to facilitate operations which involve mounting and removal of the different wheels carried by a polishing head and thus to permit simultaneous mounting or removal of all polishing wheels. Furthermore, the design concept of this device is such as to permit full automation of these operations.

To this end, the device in accordance with the invention comprises two coupling members provided respectively on the free ends of the driving shafts and on the corresponding coupling faces of the polishing wheels. The first coupling member is designed in the form of a disk or plate having a frusto-conical external wall whilst the second coupling member is adapted to clamp the external wall of said plate. However, the distinctive feature of said device lies in the fact that:

the second coupling member is formed of material which is at least partly elastic and is designed in the shape of a cup having a frusto-conical internal wall similar in profile to the external wall of the plate which constitutes the first coupling member;

the bottom wall of said cup-shaped member is provided with:

a bore through which air is discharged at the time of forcible assembly of the two coupling members and through which air under pressure is blown-in between said members in order to separate these latter;

a recess for constituting a pressure chamber at the time of blowing of air under pressure through the bore for the purpose of separating said two coupling members.

Thus the mounting of polishing wheels on a polishing head can be effected simultaneously by force-fitting of the two coupling members of the device under consideration. In regard to the removal or disassembly operation, this operation can be performed by blowing air under pressure between the two coupling members in order to separate these latter by driving out the air from the resilient cup-shaped coupling member.

These operations can therefore be performed with great ease and simultaneously in the case of all the polishing wheels of one and the same polishing head. Furthermore, these operations can be made fully automatic.

BRIEF DESCRIPTION OF THE DRAWINGS

Other features of the invention will be more apparent to those skilled in the art upon consideration of the following description and accompanying drawings, wherein.

DESCRIPTION OF THE PREFERRED EMBODIMENTS

Figure 1:
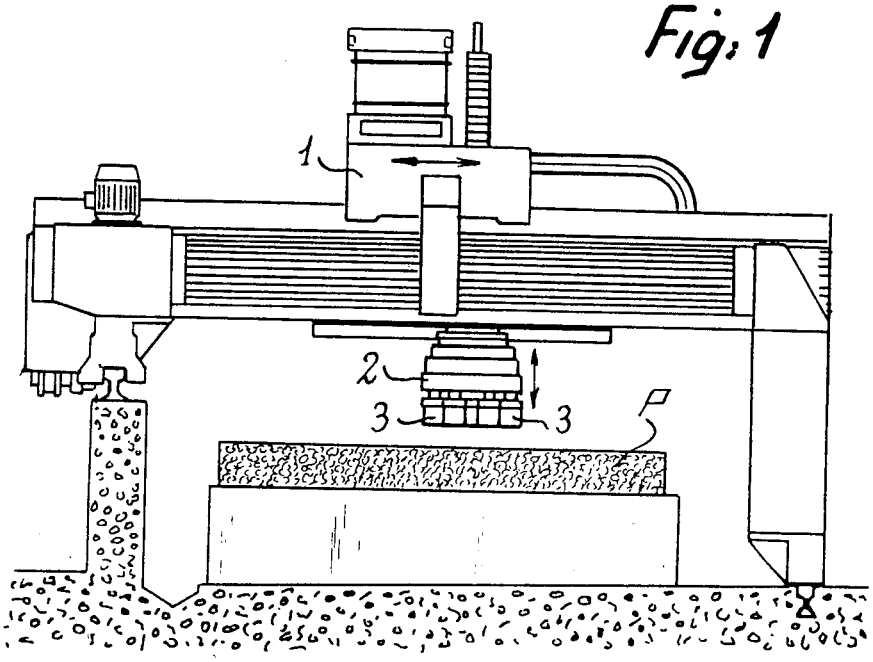
FIG. 1 is an end view in elevation of a polishing machine.
Figure 2:
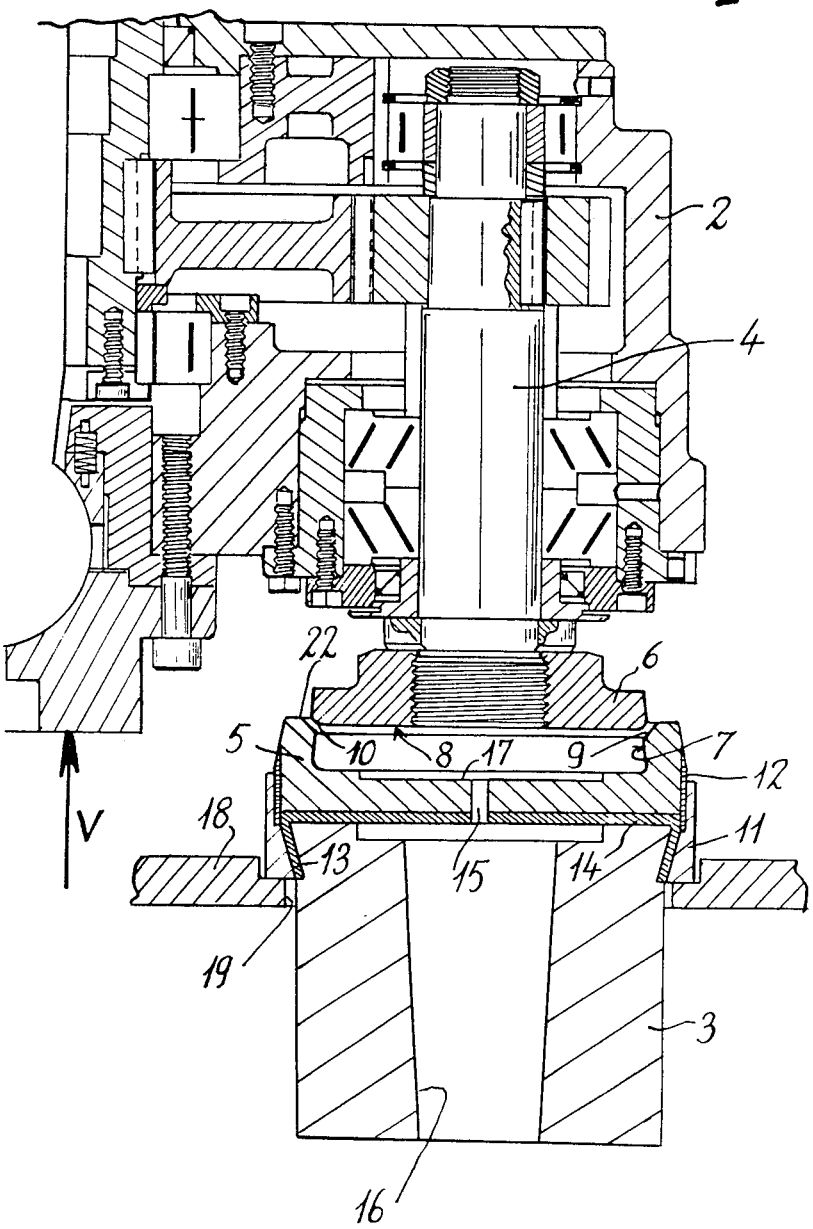
FIG. 2 is a part-sectional view of the polishing head of said machine and showing one of the working wheels prior to coupling of said wheel to the corresponding plate.

The polishing machine illustrated in FIGS. 1 and 2 comprises a carriage 1 provided with a polishing head 2 equipped with a set of working wheels 3 consisting of six wheels, for example. Each wheel is fixed at the end of a rotary drive shaft 4.

In accordance with the invention, the polishing wheels are mounted at the ends of the shafts 4 by means of a device constituted by the combination of the two following coupling members:

first rigid member 6 designed in the form of a disk or plate having a frusto-conical external wall;

a second cup-shaped member 5 formed of resilient or partially resilient material and adapted to receive the first member by forcible engagement of this latter within said second member.

One of these two members is fixed beforehand on the end of one of the rotary shafts 4 of the polishing head whilst the other coupling member is carried by a polishing wheel 3. Thus in the example illustrated in FIGS. 1 to 3, the cup-shaped member 5 is carried by a wheel 3 and the rigid plate 6 is fixed beforehand on a shaft 4 of the polishing head.

Said plate is fabricated from metal or any other suitable rigid material. On the other hand, the second cup-shaped member 5 is formed of material which is endowed with a sufficient degree of hardness but is at least partially resilient such as a material having a base of synthetic resin, for example, in order to permit engagement of said member 5 over the plate 6 by elastic deformation.

Figure 3:
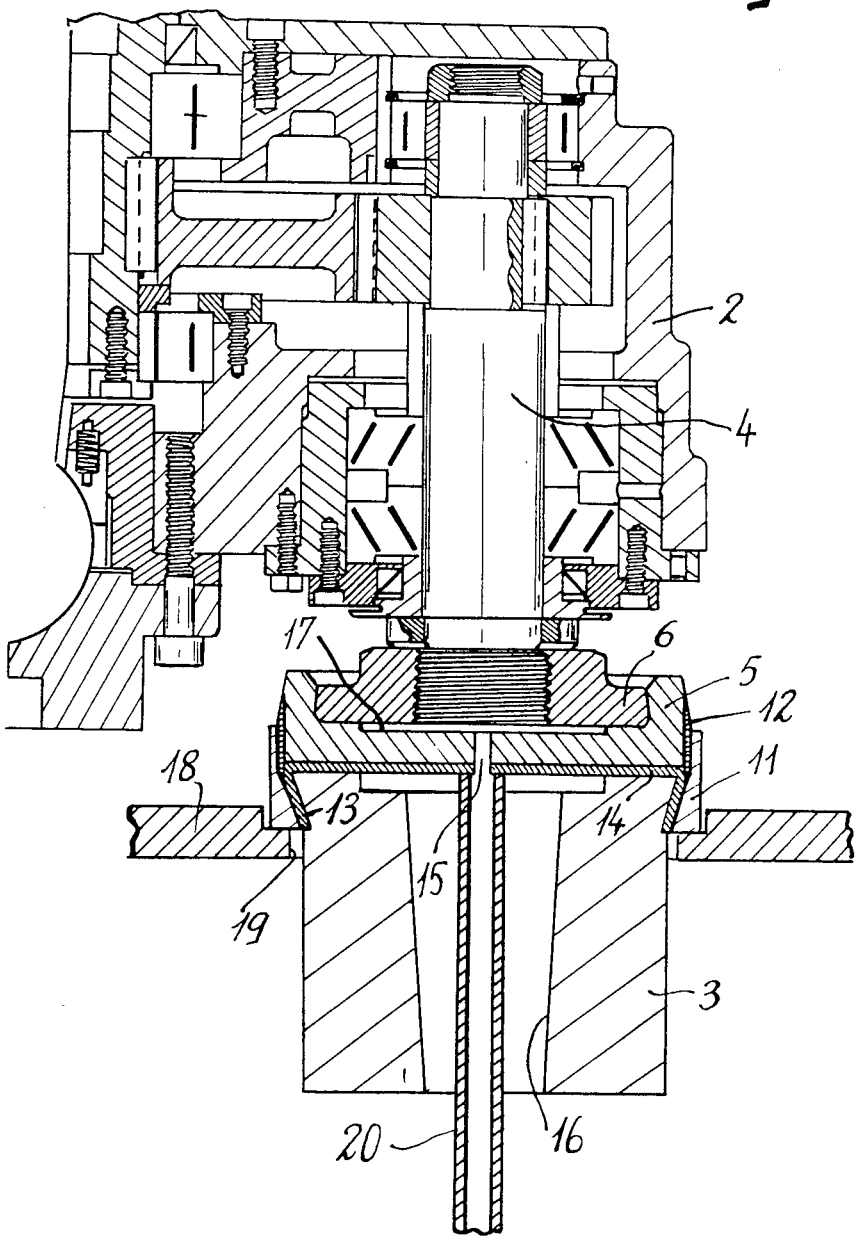
FIG. 3 is a similar view which illustrates the beginning of the operation which involves uncoupling of the same wheel with respect to its receiving plate (members still coupled together)

As will be apparent from FIGS. 2 and 3, the periphery of the plate 6 has a frusto-conical shape and the wall 7 of the cup-shaped member 5 has a similar profile inasmuch as it increases in cross-sectional area from the top to the bottom wall. However, the respective cross-sections of said cup are, in the state of rest, slightly smaller in area than the corresponding cross-sections of the plate 6 in order to obtain a highly rigid assembly of these two members when they are coupled together. However, this rigid assembly can be increased even further by providing a knurled surface or any other suitable relief on the bottom surface 8 of the plate 6. A flared-out portion 9 is preferably formed at the entrance of the cup-shaped member 5 in order to facilitate insertion of the plate 6 within the cup. With the same object in view, the plate 6 can be provided with a rounded portion or chamber 10 at its periphery.

Figure 4:
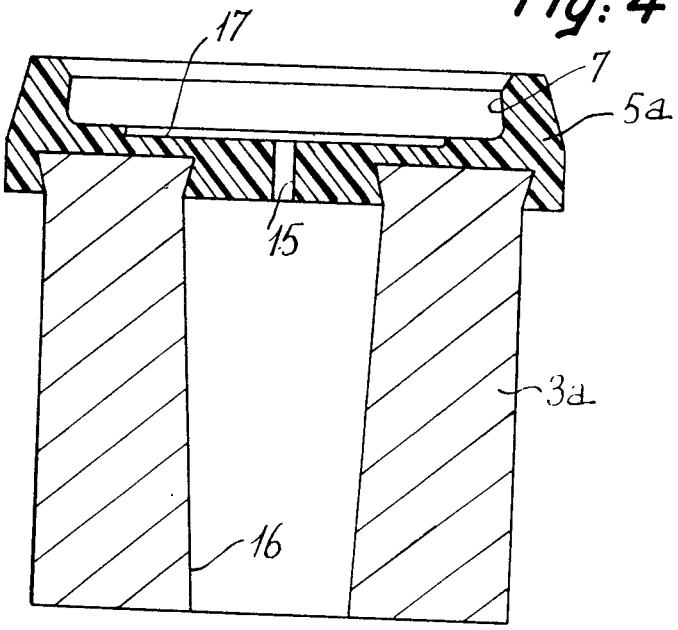
FIG. 4 is an axial sectional view of a wheel equipped at the time of manufacture with a cup-shaped support constituting one of the two members of the device under consideration.

In the example illustrated in FIGS. 2 and 3, the second cup-shaped coupling member 5 is applied on the mounting face of the polishing wheel 3 and fixed against this latter by means of a ring 11 which is screwed on said cup-shaped member or on a sleeve 12 which surrounds said member and is rigidly fixed to this latter. Said assembly ring has a frusto-conical bearing surface which is applied against the frusto-conical skirt 13 of a rubber base 14 fitted around the corresponding end of the wheel 3. This arrangement makes it possible to recover the corresponding coupling member 5 after the polishing wheel 3 has become worn. However as shown in FIG. 4, this cup-shaped member can consist of a member **5*a* which is made permanently integral with the corresponding wheel 3*a*** at the time of manufacture of this latter. In such a case, said coupling member is clearly lost since the polishing wheel is discarded after wear.

In one case as in the other, the cup-shaped bottom wall of the member 5 or **5*a* is provided with an axial duct 15 which opens into the bore 16 formed in the wheel 3. At its opposite end, said duct opens into a cavity 17 which is formed in the bottom wall of the cup 5 and is intended to constitute a pressure chamber at the time of uncoupling of the two members 5 and 6** as will be explained hereinafter.

The operations of mounting and removal of the different wheels with which the polishing head 2 is equipped are carried out as follows :

Mounting of Polishing Wheels

In order to mount the wheels in position, it is only necessary to force-fit the cup-shaped coupling member 5 carried by each wheel over the corresponding receiving plate 6. This can very readily be achieved by forcible engagement by virtue of the elasticity of the wall of said coupling member.

The basic concept of the device in accordance with the invention is such that all the wheels of the polishing head can be mounted in position simultaneously. To this end, these various wheels can be placed beforehand on a platform 18 provided with a series of openings 19 corresponding to each polishing wheel. Said wheels are then engaged within the openings and are each supported on the top face of the platform 18 by the ring 11 as shown in FIG. 2. The location of the openings 19 corresponds to the position of the different driving shafts 4 provided on the polishing head. It is only necessary to produce a relative movement between the head and the platform 18 in order to achieve simultaneous coupling of all the wheelcoupling members 5 to the different receiving plates 6. This movement can be controlled by any suitable means which may be mechanical, hydraulic, pneumatic, and so on.

At the time of this operation, the duct 15 formed in the bottom wall of each cup-shaped member 5 permits downward escape of the air compressed between said member and the receiving plate 6.

Removal of Polishing Wheels

When it is necessary to carry out disassembly of the polishing wheels 3 in order to replace them by other wheels, the polishing head 2 should again be placed in position opposite to the magazine platform 18 in order to deposit the wheels within the openings 19. The different wheels then come to rest on the platform 18 and are supported on this latter by their assembly rings 11. The next step consists in engaging an air-blowing nozzle 20 through the bore 16 of each wheel in order to apply the end of this latter against the duct 15 of the cup-shaped coupling member 5 of each wheel (as shown in FIG. 3). It is then only necessary to blow air under pressure through these different nozzles in order to produce uncoupling of the two members 5 and 6. In fact, the air thus blown-in reaches the chamber 17 formed in the bottom wall of the cup 5 and consequently has the effect of separating the two members 5 and 6. It is readily apparent that any other fluid under pressure could be employed instead of compressed air.

Figure 5:
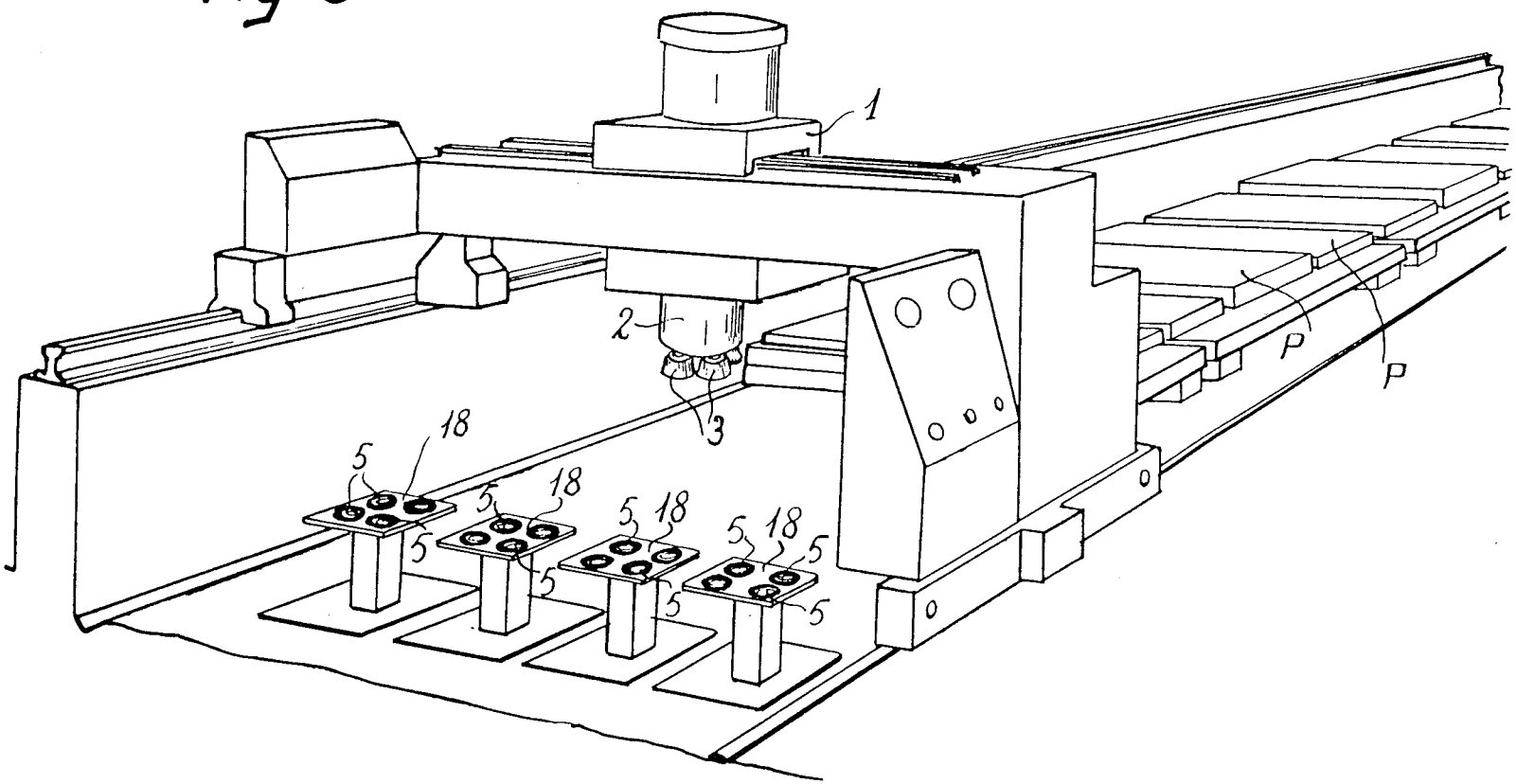
FIG. 5 is a schematic view in perspective showing a polishing machine equipped with magazines for storing a number of sets of wheels to be fitted on the polishing head of machine.

As illustrated in FIG. 5, it is possible to equip a polishing machine with a plurality of platforms such as the platform 18 described earlier. Each platform accordingly serves as a storage magazine for a series of standby polishing wheels 3 having the same grain size. A suitable control system serves to bring the polishing head into position above the platform 18 on which the wheels to be mounted on the head are placed. The same system then serves to return said polishing head to a position above the magazine platform in order to leave the corresponding wheels therein after completion of the work cycle in which they have been employed, whereupon the polishing head is brought into position above another magazine platform 18, and so on in sequence.

In a different mode of operation, the head can be positioned at a precise location which always remains the same and serves to couple and uncouple the polishing wheels. In this case the platforms 18 will be both presented at this location and subsesquently stored by means of an automated system.

The principal advantage of the device in accordance with the invention lies in the ease and rapidity of mounting and removing operations performed on the different wheels which equip a polishing head. Despite the absence of all mechanical assembly means (such as keys, splines and the like), the present device ensures perfect coupling between each polishing wheel and its driving shaft by adherence between the members 5 and 6. The frusto-conical shape of the driving plate 6 and of the cup 5 forestalls any danger of accidental disengagement during a polishing operation.

Another important advantage of the device in accordance with the invention lies in a design concept which permits the possibility of automation of all the operations required for mounting and demounting of all the wheels with which any one polishing head is equipped.

However, this device also offers a certain number of additional advantages, in particular the following :

(a) By virtue of the mode of coupling which is thus provided, this device guards against any potential danger of damage to the polishing machine at the time of impact of a polishing wheel against an obstacle. In fact, if the impact sustained exceeds the maximum design torque, a relative sliding displacement of the receiving plate 6 may take place within the corresponding cup-shaped member 5.

(b) This coupling system has the further advantage of ensuring that the polishing wheels are maintained in slightly convergent axes in order that they may accordingly be permitted to work under optimum conditions.

(c) Furthermore, this coupling system does not present any danger of seizure, which is not the case with devices involving assembly by screwing or the like.

FIGS. 6 to 9 illustrate a number of other embodiments of the device in accordance with the invention.

Figure 6:
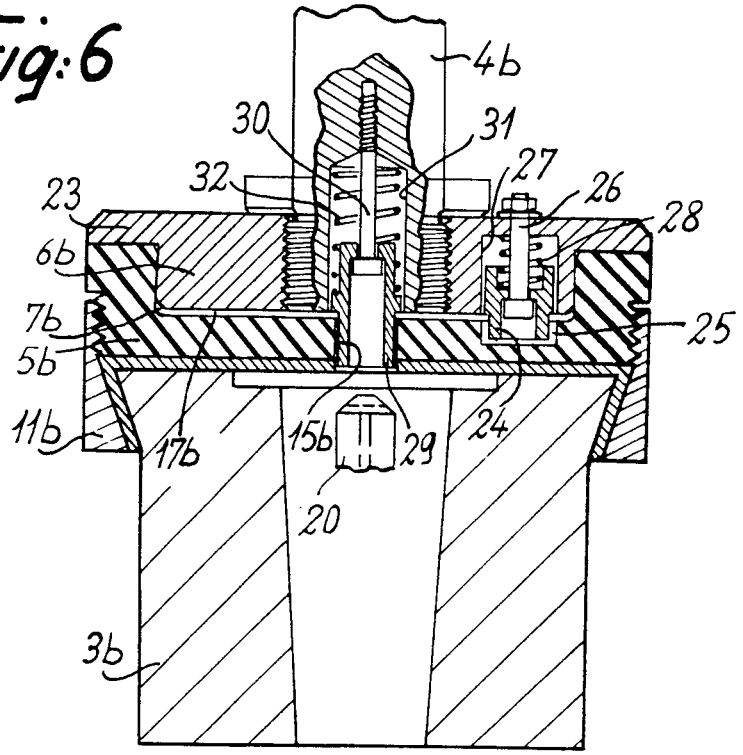
FIGS. 6 to 9 are axial sectional views of several other embodiments of the mounting device in accordance with the invention.

In the embodiment shown in FIG. 6, the mounting device has the same general structure as in the case of FIGS. 1 to 5. In fact, this device is constituted by the combination of two complementary coupling members, namely as follows :

a deformable cup-shaped member **5*b* which is fitted on the mounting face of a polishing wheel 3*b***;

and a rigid receiving plate **6*b* which is fixed on the end of one of the rotary shafts 4*b*** of a polishing head.

As in the previous embodiment, the periphery of the plate **6*b* has a frusto-conical shape and the internal space 7*b* of the cup-shaped member 5*b*** has a similar profile with a cross-section which increases in area towards the bottom wall.

In the present embodiment, said plate **6*b* is distinguished by the fact that it has a peripheral annular flange 23 against which the edge of the cup-shaped member 5*b* is applied when these two members are coupled together (as shown in FIG. 6). This has the advantage of increasing the diameter of the bearing surface of said member and of providing this latter with a larger seating area. The effect thereby achieved is to ensure strict compliance with the predetermined angle of inclination of the polishing wheel 3*b* under operating conditions, this angle being determined by the spatial arrangement of the axis of the rotary shaft 4*b***.

Furthermore, the annular flange 23 of the plate **6*b* has the advantage of completely covering the deformable cup-shaped member 5*b***. This prevents any introduction of foreign bodies within said member while work is in progress.

Moreover, the rigid plate **6*b* is provided with one or a number of projecting coupling studs 24 whilst the bottom wall of the internal space 7*b* of the member 5*b* is provided with a corresponding number of blind-end bores 25 which are adapted to receive said studs. Preferably, these studs are mounted in such a manner as to be capable of withdrawing into the interior of the plate 6*b*. To this end, said studs are slidably mounted on guide rods 26 carried by said plate and are capable of withdrawing into the interior of cavities 27 of this latter. However, springs 28 tend to thrust said studs into the projecting position shown in FIG. 1**.

At the time of engagement of the member **5*b* on the plate 6*b*, said coupling stud or studs are thrust back into their housings. However, if a relative movement of rotation takes place between the member 5*b* and the plate 6*b*, the coupling studs 24 penetrate automatically into the blind-end bores 25 as soon as they come into position opposite to these latter. This accordingly ensures perfect rotational locking between the coupling member 5*b* and the receiving plate 6*b*** without entailing any need to provide surface relief portions for interengagement of these two members.

Furthermore, the mounting device under consideration comprises a retractable member which is capable under normal conditions of shutting-off the duct **15*b* provided at the center of the coupling member 5*b* for blowing air by means of a nozzle 20 as described in the main patent. This closure member 29 is slidably mounted on a guide rod 30 carried by the end of each rotary shaft 4*b* of a polishing head. The arrangement is such that said closure member is capable of withdrawing into a cavity 31 provided within the end portion of said shaft. However, a spring 32 tends to urge said closure member 29 to the projecting position which is shown in FIG. 1 and in which it is accordingly located inside the duct 15*b* of the cup-shaped coupling member 5*b*. In this position, said member therefore shuts-off said duct and prevents any penetration of impurities or foreign bodies into the internal space 7*b* of the cup-shaped member 5*b***.

However, when carrying out the wheel-removing operation by blowing air under pressure through the duct **15*b*, the end of the nozzle 20 which is employed for this purpose thrusts back the closure member 29 in opposition to the spring 32. This accordingly has the effect of shutting-off the duct 15*b* in order that the air blown-in may penetrate into the internal space 7*b*. It should be noted in this connection that, in the embodiment shown in FIG. 6, the pressure chamber 17*b* formed between the bottom wall of the coupling member 5b and the corresponding face of the plate 6b has a larger volume than the chamber provided in the embodiments described earlier. This increase in volume arises from the fact that said chamber extends over the entire surface of the bottom wall of the internal space 7b of the member 5b. This is made possible by the fact that it is no longer necessary to ensure that the bottom wall of said member is directly applied against the receiving plate 6b since these two members are in direct contact at the point corresponding to the annular flange 23** of said plate.

In point of fact, the increase in volume of the chamber 17b has an advantage in that disengagement of the coupling member 5b can be obtained with a lower pressure than in the embodiments described in the foregoing.

It should be noted that the coupling member 5b is detachably mounted on the corresponding wheel by means of a ring 11b as is the case in the embodiments shown in FIGS. 2 and 3. In consequence, the coupling member 5b can be recovered when the wheel 3b is completely worn and it can then be mounted on another identical wheel. However, the deformable coupling member 5b could also be stationarily fixed with equal ease on the mounting face of the corresponding wheel 3b.

Figure 7:
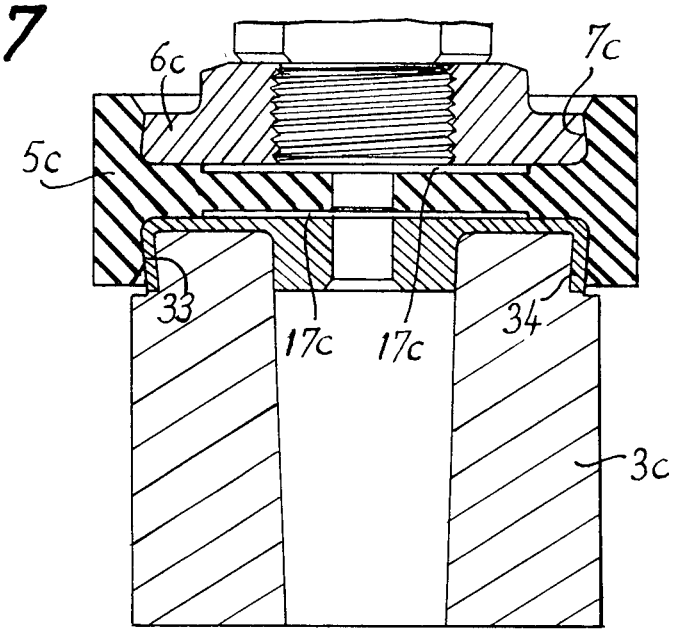

FIG. 7 illustrates an alternative embodiment of the mounting device in accordance with the invention. In this variant, provision is again made for a rigid receiving plate 6c which is fixed on the end of the corresponding rotary shaft 4c of a polishing head. However, in addition to a cup 7c which is intended to receive said plate, the complementary coupling member 5c provided in this alternative embodiment has another similar cup 33 on its opposite face. This second cup is tightly engaged on a rigid member 34 having the same profile and provided on the mounting face of the corresponding wheel 3c.

Thus the deformable coupling member 5c is virtually associated with two rigid plates which can be coupled with this latter. In consequence, said coupling member serves as an intermediary between the wheel 3c and the corresponding rotary shaft 4c. Provision is accordingly made for two pressure chambers 17c located in the bottom of two cups formed in the member 5c. Both the wheel 3c and the coupling member 5c can thus be removed from the corresponding rotary shaft 4c, this being achieved by blowing air into these two chambers by means of a nozzle 20.

Figure 8:
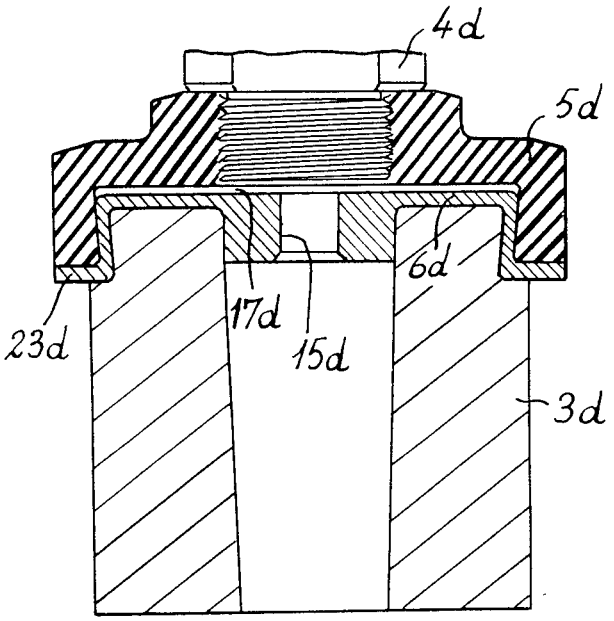

FIG. 8 illustrates another alternative embodiment in which the arrangement of the two coupling members of the mounting device is reversed with respect to the arrangement provided in the embodiments illustrated in FIGS. 1 to 6. In fact, the deformable coupling member 5d of the corresponding device is fixed on the end of the rotary shaft 4d of the polishing head of a polishing machine whereas the corresponding rigid plate 6d which is intended to be engaged within said member is fitted on the mounting face of a wheel 3d. Said plate is preferably provided with an annular flange 23d which is similar to the annular flange 23 shown in FIG. 1 in order to ensure that the edge of the deformable member 5d is brought to bear on this latter.

As will readily be understood, a pressure chamber 17d is formed between the plate 6d and the bottom wall of the cup of the deformable member 5d. In addition, a bore 15d is formed at the center of the plate 6d in order to permit injection of air under pressure within said chamber with a view to removing the polishing wheel by thrusting said plate away from the cup of the member 5d.

By means of this mounting device, the operations involved in attachment of a wheel to the rotary shaft of a polishing head and withdrawal of said wheel from said shaft remain exactly the same as in the case of the embodiments described earlier. This device consequently offers the same advantages.

Figure 9:
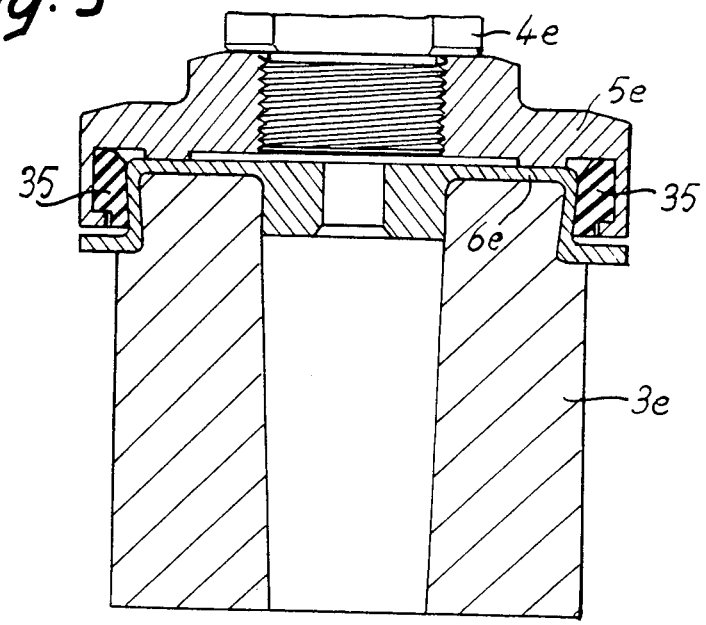

FIG. 9 illustrates yet another alternative embodiment in which the cup-shaped coupling member 5e is also fixed on one of the rotary shafts 4e of a polishing head whereas the rigid plate 6e which is intended to be engaged within said member is fitted on the mounting face of a wheel 4e. However, this alternative embodiment differs from that of FIG. 8 in the fact that the body of the cup-shaped member 5e is formed of rigid material and contains an annular packing-seal 35 of elastic material. This packing-seal forms the internal wall of the cup within which the receiving plate 6e is inserted in a force fit. Under these conditions, said packing-seal 35 virtually constitutes the deformable cup which serves as a housing for said plate when the two coupling members of the present device are assembled together.

However, the mode of utilization of the present mounting device remains the same as before. Furthermore, this latter retains the same advantages.

It is wholly apparent that, in the case of this alternative embodiment, it would be equally possible to fit the cup-shaped coupling member 5e on the mounting face of the wheel 4e, in which case the rigid plate 6e would be fixed on the end of the rotary shaft 4e.

Many other alternative forms of construction could in any case be contemplated without thereby departing either from the scope or the spirit of the invention.

What is claimed is:

1. A device for mounting and removal of polishing wheels carried by rotary shafts of the polishing head of a polishing machine by means of two coupling members provided respectively on the free ends of said rotary shafts and on the coupling faces of said polishing wheels, the first coupling member being designed in the form of a disk or plate having a frusto-conical external wall whilst the second coupling member is adapted to clamp the external wall of said plate, wherein:

the second coupling member is formed of material which is at least partly elastic and is designed in the shape of a cup having a frusto-conical internal wall similar in profile to the external wall of the plate which constitutes said first coupling member ;

the bottom wall of said cup-shaped member is provided with:

a bore through which air is discharged at the time of forcible assembly of the two coupling members and through which air under pressure is blown-in between said members in order to separate these latter ;

a recess for constituting a pressure chamber at the time of blowing of air under pressure through the bore for the purpose of separating said two coupling members.

2. A device according to claim 1, wherein the cup-shaped coupling member has a flared-out engagement edge whilst the external face of the other coupling member in the form of a plate has a chamfered or rounded edge.

3. A device according to claim 1, wherein the first plate-type coupling member is provided with striations or like forms of surface relief which are capable of achieving enhanced rotational locking of said first coupling member with the second cup-shaped coupling member when these two members are assembled together.

4. A device according to claim 1, wherein the first plate-type coupling member has an annular flange which is capable of serving as a bearing surface for the edge of the second cup-shaped coupling member.

5. A device according to claim 1, wherein the first plate-type coupling member is adapted to carry one or a number of coupling studs which are preferably retractable and the bottom wall of the second cup-shaped coupling member is provided with a corresponding number of blind-end bores which are capable of receiving said coupling stud or studs.

6. A device according to claim 1, wherein provision is made on the end of each rotary shaft of the polishing head for a retractable member which is capable of shutting-off the bore formed at the center of the second cup-shaped coupling member.

7. A device according to claim 1, wherein the second coupling member is constituted by a rigid cup-shaped component within which is provided an annular packing-seal of elastic material which is capable of undergoing deformation in order to receive the rigid coupling plate.

8. A device according to claim 7, wherein the second cup-shaped coupling member is fitted on the mounting face of the corresponding polishing wheel and fixed in position by means of a screwed ring or the like.

9. A device according to claim 7, wherein the second cup-shaped coupling member is rigidly fixed to the mounting face of the corresponding polishing wheel at the time of fabrication of said wheel.

10. A device according to claim 7, wherein the second cup-shaped coupling member is fixed on the free end of the rotary shaft of the polishing head, in which case the airflow bore is provided in the first plate-type coupling member which is rigidly fixed to the corresponding polishing wheel.

11. A device according to claim 7, wherein the second coupling member is independent and provided with a deformable coupling cup on each face thereof and said member is associated with two rigid coupling plates, one coupling plate being fixed to the end of a rotary shaft of the polishing head whilst the other coupling plate is fitted on the mounting face of a polishing wheel.

12. A device according to claim 1 wherein, in combination with a series of polishing wheels which are provided with a coupling member in each case and which are intended to be mounted simultaneously on one and the same polishing head of a polishing machine, said device comprises a magazine platform provided with a series of housings, one polishing wheel being placed in readiness within each housing prior to being mounted on the corresponding polishing head so that said polishing wheels can be fixed on the rotary shafts of said polishing head by forcible engagement of the coupling members under the action of a relative movement of approach of said magazine platform and said polishing head.

13. A device according to claim 12, wherein a movable nozzle for blowing air under pressure is placed opposite each of the different housings of the magazine platform, said nozzle being adapted to fit in a duct formed in the bottom wall of the coupling member of a polishing wheel in order to produce disengagement of this latter with respect to the coupling member carried by the corresponding rotary shaft of the polishing head.

* * * * *